US012385119B2

(12) United States Patent
Larsson et al.

(10) Patent No.: US 12,385,119 B2
(45) Date of Patent: Aug. 12, 2025

(54) WEAR RESISTANT COMPOSITE

(71) Applicant: CONV AUSTRALIA HOLDING PTY LTD, Sydney (AU)

(72) Inventors: Oskar Larsson, Sydney (AU); Stefan Ederyd, Sydney (AU)

(73) Assignee: CONV AUSTRALIA HOLDING PTY LTD, Sydney (AU)

( * ) Notice: Subject to any disclaimer, the term of this patent is extended or adjusted under 35 U.S.C. 154(b) by 64 days.

(21) Appl. No.: 17/910,012

(22) PCT Filed: Dec. 8, 2020

(86) PCT No.: PCT/AU2020/051336
§ 371 (c)(1),
(2) Date: Sep. 8, 2022

(87) PCT Pub. No.: WO2021/184057
PCT Pub. Date: Sep. 23, 2021

(65) Prior Publication Data

US 2023/0125758 A1 Apr. 27, 2023

(30) Foreign Application Priority Data

Mar. 18, 2020 (AU) ..... 2020900828

(51) Int. Cl.

| | |
|---|---|
| ***C22C 47/08*** | (2006.01) |
| ***B22D 15/00*** | (2006.01) |
| ***B22D 19/02*** | (2006.01) |
| ***C22C 49/08*** | (2006.01) |

(52) U.S. Cl.
CPC ..... *C22C 47/08* (2013.01); *B22D 15/00* (2013.01); *B22D 19/02* (2013.01); *C22C 49/08* (2013.01)

(58) Field of Classification Search
None
See application file for complete search history.

(56) References Cited

U.S. PATENT DOCUMENTS 4,119,459 A * 10/1978 Ekemar ..... C22C 37/00 428/564
2013/0196169 A1 8/2013 Boddapati
2015/0299827 A1* 10/2015 Ederyd ..... C22C 49/14 164/75

FOREIGN PATENT DOCUMENTS

| | | |
|---|---|---|
| JP | H09209071 | 8/1997 |
| JP | 2008049399 A | 3/2008 |
| JP | 2011520031 A | 7/2011 |
| WO | 2004042102 A1 | 5/2004 |

OTHER PUBLICATIONS

European Search Report (Feb. 21, 2024) for corresponding European App. EP 20 92 4998.

(Continued)

*Primary Examiner* — Daniel J. Schleis
(74) *Attorney, Agent, or Firm* — WRB-IP PLLC

(57) ABSTRACT

A composite body and a method for producing an integrally cast composite body, which includes at least two zones. A first zone is substantially formed of metal material, and, a second zone additionally includes a non-metallic reinforcing material, such as cement carbide. The composite body is particularly useful for producing products which have at least one wear resistant zone or surface.

5 Claims, 4 Drawing Sheets

(56) References Cited

OTHER PUBLICATIONS

Rojacz H et al: "Processing and wear of cast MMCs with cemented carbide scrap", Journal of Materials Processing Technology, Elsevier, NL, val. 214, No. 6, Jan. 28, 2014 (Jan. 28, 2014), pp. 1285-1292, XP028624309, ISSN: 0924-0136, DOI: 10.1016/J.JMATPROTEC.2014.01.011 * 2.1 casting procedure; p. 1286 * * 2.2 Materials and characterisation; p. 1287 * * figures 1, 3, 4 * * 2.3 Abrasion testing; p. 1287-p. 1288.
Chilean Search Report (Sep. 13, 2023) for corresponding Chilean App. 202202109.
International Search Report (Feb. 22, 2021) for corresponding International App. PCT/AU2020/051336.

* cited by examiner

WEAR RESISTANT COMPOSITE

BACKGROUND AND SUMMARY

The present invention relates to a composite body which is substantially formed of a metal material, and, in which a portion of the body includes a reinforcing material, such as cemented carbide.

The present invention also relates to such a composite body being used as a wear-resistant component, and, which incorporates an integrally formed wear resistant portion therein.

The present invention also relates to a method of casting a composite body, in which the reinforced portion is integrally formed therein.

Any reference herein to known prior art does not, unless the contrary indication appears, constitute an admission that such prior art is commonly known by those skilled in the art to which the invention relates, at the priority date of this application.

In many industries, such as in the mining, earthmoving and manufacturing industries, various machines, machine components and tools are prone to significant wear during use. This is mainly due to materials impacting their surfaces, and/or due to the component surfaces rubbing together.

Whilst commonly cast metals such as iron alloys are typically used to manufacture such machinery, those parts of the machines which are subject to these impacts, tend to wear quickly. As such, certain component parts from of these machines are typically manufactured from materials which have increased wear resistance. These components are traditionally manufactured from an alloy, and may typically be made more wear resistant by adding a harder metal to a base metal material, or, more recently by making these components from a metal matrix composite (MMC). These MMC products are produced by mixing a non-metallic reinforcing material, such as cemented carbide, into a molten metal material prior to casting.

For example, U.S. Pat. No. 4,119,459 discloses a composite body, formed of a cast alloy and cemented carbide, to produce a component or tool. Whilst products produced by this process may provide the desired characteristics of increased wear resistance, these products can be expensive to produce.

To minimise these production costs, only the particular component parts of the machine which are going to be subjected to wear, are typically produced from this wear resistant material. For example, a wear component in the form of a liner may be manufactured in this way, and, it is then welded, bolted or otherwise attached to the machine. After a period of use, when the liner component wears out, the liner component or wear plate may be removed and replaced.

Whilst the provision of these wear resistant components or wear plates prolongs the use of the machine, the replacement of the wear plates, typically by welding, can be a labour intensive, time consuming, and costly process, and can sometimes require significant down time of the machine as it is not capable of being used during this process.

It is desirable to overcome at least some of the disadvantages of the prior art.

It is also desirable to provide an alternative form of composite body which has wear resistant properties.

It is also desirable to provide an alternative method of manufacturing a composite body which has differences and advantages over prior art manufacturing methods.

In one board form, the present invention provides, according to an aspect thereof, a composite body, which is substantially formed of a casted metal material, and which includes at least one integrally formed reinforced portion incorporating a reinforcing material therein.

In some forms, said casted metal material includes any one or combination of iron, nodular iron, iron alloy, iron matrix, spheroidal graphite iron (SGI), steel, steel alloy, an alloy of chromium cast iron.

In some forms, said reinforcing material includes any one or combination of carbide, cemented carbide, niobium carbide (NbC), cemented niobium carbide, ceramics (Al2O3), SiC, NbC embedded in a Fe matrix.

In some forms, said reinforcing material is in the form of any one or combination of granules, particles, tiles, fibres, inserts, or the like.

In some forms, the reinforcing material is in the form of cemented carbide granules predominantly having a diameter in the range of about 3 mm to about 12 mm, and preferably whereby about 30 wt-% of the granules is in the range of 3 mm to 5 mm, about 30 wt-% of the granules are in the range of 6 mm to 9 mm, and about 40 wt-% of the granules is in the range of 10 mm to 12 mm.

In some forms, the reinforcing material is included up to about 50% of the total thickness of the composite body.

In a further broad form, the present invention provides, according to an aspect thereof, a composite body including, a first zone, substantially formed of metallic material; and, a second zone, formed of a combination of said metallic material of said first zone, and, a reinforcing material.

In some forms, the reinforcing material is substantially evenly distributed throughout the second zone.

In some forms, the reinforcing material is cemented carbide.

In some forms, a transition zone, intermediate said first and second zones, formed of a combination of said metallic material and said non-metallic reinforcing material of said second zone, but wherein the relative proportion of said reinforcing material is lower than in that of said second zone.

In some forms, in said transition zone, the relative proportion by volume of reinforcing material is between 20% to 80%, preferably between 30% to 80%, and more preferably between 40% to 80% of that of said second zone.

In a further board form, the present invention provides, according to an aspect thereof, a method of producing a composite body which includes a reinforced portion, including the steps of: lining at least a portion of a surface of a mould with a reinforcing material; and, pouring a molten material into said mould.

In a further board form, the present invention provides, according to an aspect thereof, a method of manufacturing a wear product, including the steps of: lining at least a portion of a surface of a mould with wear resistant material, and pouring a molten material into said mould.

In some forms, said reinforcing material includes any one or combination of cemented carbide.

In some forms, said reinforcing material is in the form of any one or combination of granules, particles, tiles, fibres, etc.

In some forms, a quantity of said reinforcing material is provided: about 5% to about 25% the volume of the mould, for granules; or, about 10% to about 35% the volume of the mould, for tiles.

In some forms, said lining step, a quantity of reinforcing material is selected to optimise a balance between achieving a predetermined (metallurgical) bond between said reinforcing materials and said metallic material and, a predetermined wear resistance on at least a portion of a surface of said composite body.

In some forms, said lining step, said reinforcing material is lined in said mould in one or more layers, each different layer including one or more different reinforcing material.

In some forms, prior to said lining step, said reinforcing material is treated by any one or combination of being surface treated, machined, pre-tumbled, smoothed, etc., to reduce the specific surface area (SSA) and/or lower the solubility of the material.

In some forms, prior to said pouring step, said molten metal is heated to a casting temperature sufficiently high so that no solid metal is present.

In some forms, the casting temperature is preferably in the range of about 1350° C. to 1650° C.

In some forms, during said pouring step, at least some of the reinforcing material becomes dissolved or changed into alloying phase.

In a further board form, the present invention provides, according to an aspect thereof, a product, substantially formed of a casted metal material, including an integrally formed wear resistant portion incorporating a reinforcing material therein.

In some forms, said wear resistant portion defines a wear resistant contact surface or zone.

In some forms, said product is any one of a wear plate, a conveyor component, milling plate, a mining and/or earth-moving component, road maintenance components, concrete production components, agriculture components, and screening media components.

In some forms, said product may be recycled/melted.

In a further board form, the said product may be produced by any one of the methods described herein.

BRIEF DESCRIPTION OF DRAWINGS

The present invention will become more fully understood from the following detailed description of preferred but not limiting of preferred embodiments thereof, described in connection with the accompanying drawings, wherein:

FIG. 2(*b*) shows an SEM-image of the cross-section of bulk of a composite formed in accordance with an aspect of the invention;

DETAILED DESCRIPTION

Throughout the drawings, like numerals will be used to identify like features, except where expressly otherwise indicated.

Figure 1:
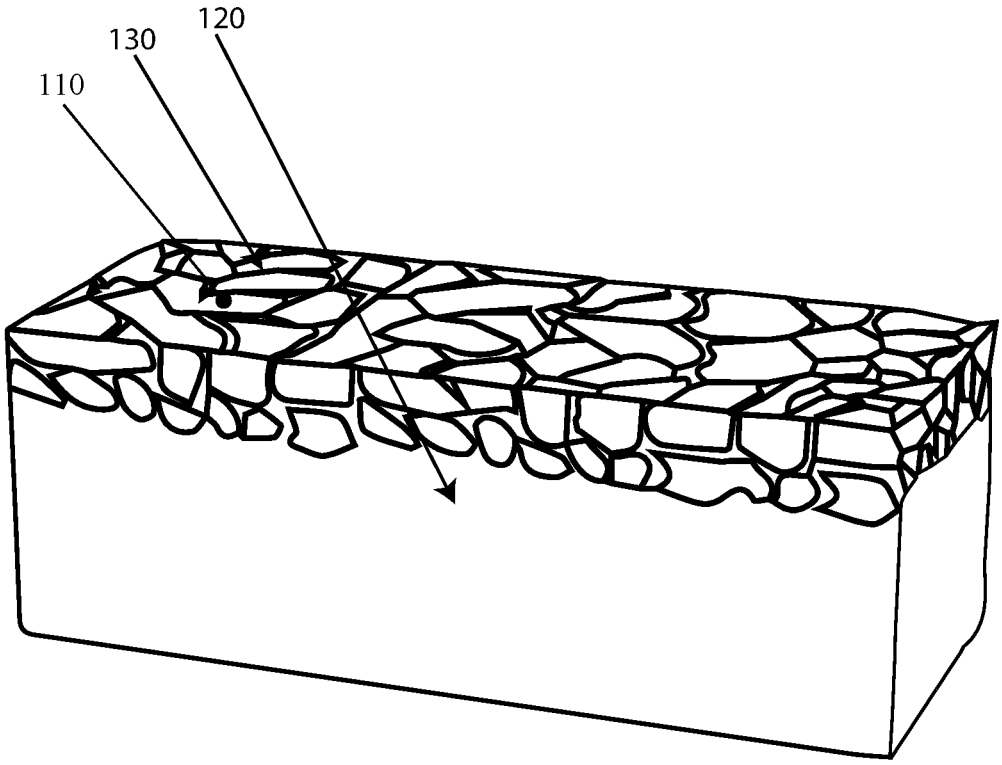
FIG. 1 shows a schematic representation of a composite formed in accordance with a preferred of embodiment of an aspect of the present invention.

In FIG. 1, is shown a schematic representation of a composite body 100 formed in accordance with a preferred embodiment of an aspect of the present invention.

The composite body, generally designated by the numeral 100, is substantially formed of a casted material, and, in general terms, includes at least two discrete zones. That is, the body 100 includes a first zone 120 which is substantially formed of metallic material, and, a second zone 110 which is formed of a combination of the same metallic material as in the first zone 120, as well as a reinforcing material in the second zone. [0051] The reinforcing material provided in the second or reinforcing zone 110 may, in one embodiment of the invention, be substantially uniformly/evenly distributed throughout the second zone 120, or, in an alternative embodiment, may be configured such that it is more densely distributed towards the surface 130 and such that it becomes less dense as it approaches the first zone 120.

The composite body 100 of the present invention, according to an aspect thereof, is typically formed by casting. That is, the composite body 100, incorporating these at least two discrete zones, is typically cast in a single casting step, as will be described in more detail hereinafter.

The metal material from which the composite body 100 is cast may be any metal or alloy which is typically used in known casting processes. As will be understood by persons skilled in the art, the choice of metal or alloy used may vary, and will largely depend on the ultimate use of the product produced.

The casted metal may, for example, include any one or combination of iron, nodular iron, iron alloy, iron matrix, nodular graphite cast iron, spheroidal graphite iron (SGI), steel, steel alloy, or any other cast iron or steel based alloy.

The reinforcing material which is additionally included in the second zone or reinforcing zone 110 of the composite body 100, may preferably include any one or combination of materials including, but not limited to, carbide, cemented carbide, niobium carbide (NbC), cemented niobium carbide, ceramics (Al2O3), SiC, NbC embedded in a Fe matrix etc.

The reinforcing material is preferably in the form of particulate material, such as granules, particles, fibres, inserts, tiles, pieces, powder or the like.

Whilst the particles of the reinforcing material may vary in size, by way of a non limiting example, particulate cemented carbide granules predominately having a diameter in the range about 3 mm to 12 mm may typically be utilised.

In one example, about 30 wt-% of the granules may be about 3 mm to 5 mm diameter in size, about 30 wt-% of the granules are may be about 6 mm to 9 mm diameter, and, about 40 wt %—of the granules may be 10 mm to 12 mm diameter in size.

The reinforcing zone, or second zone 110, may vary in thickness compared with that of the first zone 120, depending on the ultimate application and desired characteristics of the product produced in accordance with the invention. In one example, the thickness of the reinforcing zone 110 be up to about 50% of the thickness of the composite body 100.

In an exemplary embodiment of an aspect of the present invention using cemented carbide in the reinforcing zone or second zone, the reinforcing material may preferably have a concentration between about 20% to 80% and, more preferably between about 30% to 80%.

In certain embodiments of the invention, a transition zone may be provided between the first and second zones. In this transition zone, a combination of metallic material and reinforcing material may be provided, but such that the relative proportion of the reinforcing material in this transition zone is lower than the density of the reinforcing material in the second zone.

In one example, in this transition zone, the relative proportion by volume of the reinforcing material may be between 5-20%, preferably between 10-20%, and more preferably between 15-20%, of the reinforcing material in the second zone.

The composite body of an aspect of the present invention is distinguished from the prior art both in the selected distribution of reinforcing material throughout the composite body 100, and, by the mariner in which it is provided within the body during the manufacturing process.

In particular, the composite body of an aspect of the present invention is cast in a single casting step, that is, in a single pour of molten metal into a casting mould.

This may be facilitated by initially lining at least a portion of the mould with particles of the reinforcing material, prior to the pouring of the molten metal in to the mould.

For example, when casting using a mould made of sand, the sand mould may initially be lined with granules of cemented carbide. The granules may be provided to be of a predetermined desired thickness, depending upon the desired characteristics of the product being produced. That is, granules of reinforcing material may be positioned to either be of even thickness, or, of varying thickness, depending upon the desired positioning and relative characteristics, such as wear resistance, of the ultimate end product being produced.

In one example, cemented carbide granules may be positioned in the mould, such that they take up about 5% to 25% of the volume of the mould.

The quantity of reinforcing material positioned in the mould is preferably also additionally selected so as to optimise the strength of the metallurgical bond between the reinforcing material and the metallic material.

That is, the quantity of reinforcing material may be selected to balance a number of factors including but not limited to, achieving a predetermined bond strength between the reinforcing material and the metallic material, and, a predetermined wear resistance characteristic on at least a portion of the surface of the composite body being produced.

For example, when lining a mould with reinforcing material, the reinforcing material may be evenly distributed on the lining in the event that the desired product being produced should have a surface of even wear resistance characteristics. If, however, there are only some portions of the product, which should have increased wear resistant properties, then the granules of the reinforcing material may be solely positioned in the corresponding portions of the mould, or, an increased quantity of the granules of the reinforcing material may be provided in the corresponding portions within the mould.

In certain embodiments, various different types of reinforcing material may be used. For example, one type of reinforcing material may be positioned in a certain selected location in the mould, and, another different type of reinforcing material may be positioned in a different area in the mould. This would result in a product being produced which has two different characteristics of wear resistance, which may be desired in certain application.

Preferably or additionally, different types of reinforcing material may be provided in layers within the mould. That is, in certain embodiments, a first type of reinforcing material granules may initially be positioned in the mould, and, thereafter, a second type of reinforcing material may thereafter be layered over some or all of the first layer of reinforcing material. These different types of reinforcing materials will be readily selectable by a person skilled in the art, depending upon the characteristics of wear resistance of the product being produced.

As has been hereinbefore described, the reinforcing material may take a variety of forms, and in certain embodiments is preferably used in particulate form, such as granules. Using granules or like particulate material facilitates the positioning of two reinforcing materials in the mould so that a desired placement and thickness of the particulate form reinforcing material is readily achieved.

This also facilitates achieving an optimal metallurgical bond of the reinforcing material to the metal or alloy material which is thereafter poured or cast into the mould.

To further enhance the metallurgical bond being achieved, the reinforcing material may optionally be pre-treated.

In one example, the granules of reinforcing material may be tumbled, such that the outer surface of the granules is smoothened. This process reduces the specific surface area (SSA) of the granules.

As will be appreciated by persons skilled in the art, other than pre-tumbling the granules to achieve this effect, the granules may alternatively be machined and/or be chemically treated, etc. to achieve a similar result.

When the molten metal or alloy is poured in to the mould, the molten metal should preferably be at a casting temperature selected so that the metal is appropriately molten, and, such that an optimum bond is achieved as it contacts the reinforcing material.

This optimum temperature of the metal/alloy, in some embodiments, is selected so that some or all of the reinforcing material becomes dissolved or changed into alloying phase.

Preferably, an optimum temperature of about 1350° C. to 1650° C. is used to cast the composite. Casting at this temperature allows the composite to have a good quality metallurgical bond between the carbide and the matrix, and also, maintains the wear properties and wear life of the matrix.

As will be appreciated by persons skilled in the art, the optimal temperature of performing the casting process can vary, and is selected according to a number of factors, including, the particular composition of the reinforcing material, the desired bonds to be achieved between these materials and the base metal/alloy, and, the wear resistant properties of the product being produced.

The product produced in the process which has been hereinbefore described may typically include, but is not limited to, a component part of mining, earthmoving, conveying or transportation equipment, such as, a wear plate, a conveyor roller or other conveying component, a milling plate etc.

Exemplary Compositions of the Composite Body

By way of one example, the metallic part of the composite body may be composed of graphitic cast iron in which the carbon equivalent, Ceqv, where Ceqv is the content of carbon besides the contents of other constituent and alloying elements equivalent to carbon having influence on the properties of the cast iron, is between 2.5 wt-% to 8.0 wt-%, and preferably 3.5 wt-% to 6.0 wt-%, and, wherein the Si content is between 1.5 wt-% to 6.0 wt-%, and preferably 2.0 wt-% to 5.0 wt-%. Optionally, up to 2.5 wt-% Al may also be added.

To avoid perlite separation/content, the composition may include Manganese, Mn, preferably below 0.8 wt-%, and more preferably below 0.3 wt-%.

The composition of the graphitic cast iron should preferably be fully ferritic with silicon micro-segregation, where micro-segregation means the non-uniformity in a composition that results from non-equilibrium solidification, in solution strengthened ductile iron.

Silicon, Si, and phosphorus, P, are the elements which, next to carbon, may typically have the greatest influence on the properties of the cast iron. The carbon equivalent, Ceqv, may be defined according to the formula Ceqv (% C+(% Si/4+% P/2). Other formulas for defining the carbon equivalent Ceqv may alternatively be used to determine the carbon equivalent depending upon the specific circumstances and taking consideration for other alloying elements such as Mn (Manganese) or S (Sulphur).

Spheroidal Graphite Iron, SGI, known in the prior-art, such as EN-GJS-500-7, usually has large variations in hardness due to varying pearlite/ferrite composition. The pearlite has formed a skeleton/matrix with spherical/nodular graphite inclusions that are surrounded with ferrite. The pearlite has a somewhat strengthening effect, raising the tensile strength of the material but at the same time lowering the ductility compared to a ferritic matrix.

It has been found that second generation SGI, such as EN-GJS-500-14 or EN-GJS-00-10 is a metal matrix with 100% ferrite resulting in a similar hardness variation. Even if the metal matrix is fully ferritic throughout the component, the material is suitable for machining.

The necessary/higher mechanical properties have been obtained by solution strengthening of the ferritic matrix by an increased silicon content to 4.3 wt-% Si (for EN-GJS-600-10) resulting in a material with higher tensile strength, a higher yield strength and a better ductility compared to conventional EN-GJS-500-7. Si-solution strengthened ferritic ductile iron is tougher than ferritic-pearlitic ductile iron of the same strength. [0090] For EN-GJS-500-14, the Si content is 4.3 wt-%. With an addition of Al up to 3.16 wt-% and a Si content of 6 wt-% an even higher mechanical strength may be obtained of the SGI EN-GJS-500-14. To maintain a homogenization of the silicon micro-segregation in the ferrite matrix an addition of Al: 0.1 to 4 wt-%, most preferably 0.3 to 0.6 wt-% may be added in the SGI. The homogenization of silicon-micro-segregation leads to improved static and dynamic mechanical properties.

Traditional knowledge was doubtful about using high content of Si in SGI due to prevailing misconceptions regarding the silicon influence on brittleness and chunky graphite. One misconception is stated that " . . . increasing the silicon content over these amounts (>2.5 wt-%) apparently lowers the mechanical properties, especially toughness, tensile strength and/or ductility . . . " (U.S. Pat. No. 2,485,760 A by Millis et. al.) often summarized as "silicon makes the ductile iron brittle". This was due to relation between Silicon/Manganese. In the new second generation of SGI, the Mn content should be less than 0.8 wt-%.

In SGI, a small amount of magnesium and/or cerium is added to the melt before casting to form the graphite as sphere-like particles called nodules. Small nodules, with a diameter size above 20-30 pm, are beneficial for the mechanical properties.

In the composite body composed of cast iron and sintered cemented carbide according to the invention, the cemented carbide is preferably present as granules, pieces, crushed material, powder, pressed bodies or some other shape or structure. The cemented carbide, which contains at least one carbide besides binder metal, is normally of WC-Co-type (Tungsten Carbide Cobalt) with possible additions of carbides of Ti, Ta, Nb or other refractory metals, but also hard metal containing other carbides and binder metals may be suitable. The cemented carbide granules could have a full or partial carbide CVD (Chemical Vapour Deposition) and PVD (Physical Vapour Deposition)—hard coating but could also lack a surface coating. Pure carbides or other hard principles, i.e. without any binder phase, can also be used.

One suitable source of casted carbide is metal cutting inserts with hard coatings of alumina, TiN, TiC, Ti(C, N) Residues of alumina coating will/could affect the wettability of the granules during the casting process. By tumbling the CC-granules in silica sand or glass pearls, or other abrasives, the wettability of the granules will increase. Tumbling will also result in smooth edges/comers of the granules and less residues of hard coatings onto the granule surface, which makes the granules more suitable for casting.

When using wear-resistant steel castings, wear-resistant cast iron or other metals earlier regarded as optimum cast materials used in bonding of cemented carbide, the formed alloying phases dominates the material, because the alloy formation or the general diffusion of the elements has been too vigorous to be controlled resulting in a strong dissolution of the cemented carbide. Furthermore, the mentioned alloying phases had unfavourable properties as regards to brittleness, irregularity and porosity, which made the composite material less suitable as a wear resistant metal matrix composite. In such composite products, which preferably contain crushed cemented carbide, as in different kinds of wear parts, it has been found important that the formed alloying phase or intermediate zone between cemented carbide and cast iron is controlled regarding its extent, amount and composition to control the relation between completely transformed and partly transformed cemented carbide particles in the final product.

Figure 2A:
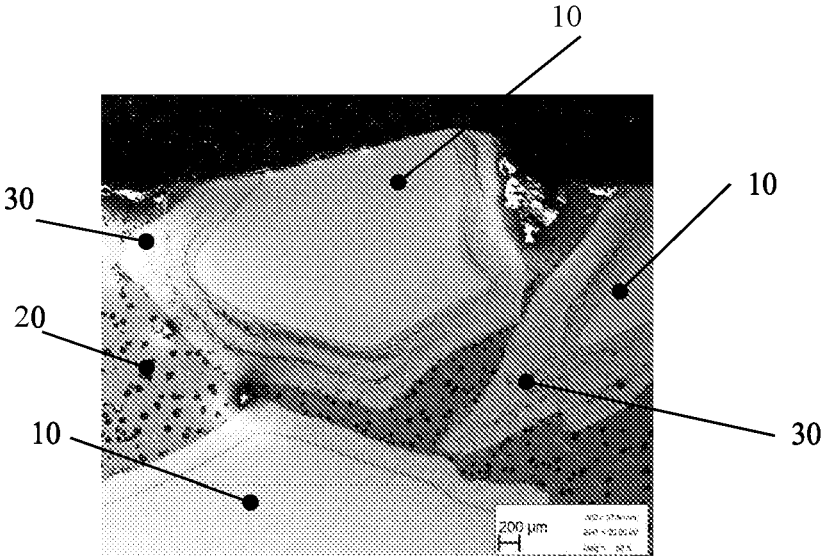
FIG. 2(*a*) shows an SEM-image of a cross-section of outermost surface of a composite formed in accordance with an aspect of the invention.
Figure 2B:
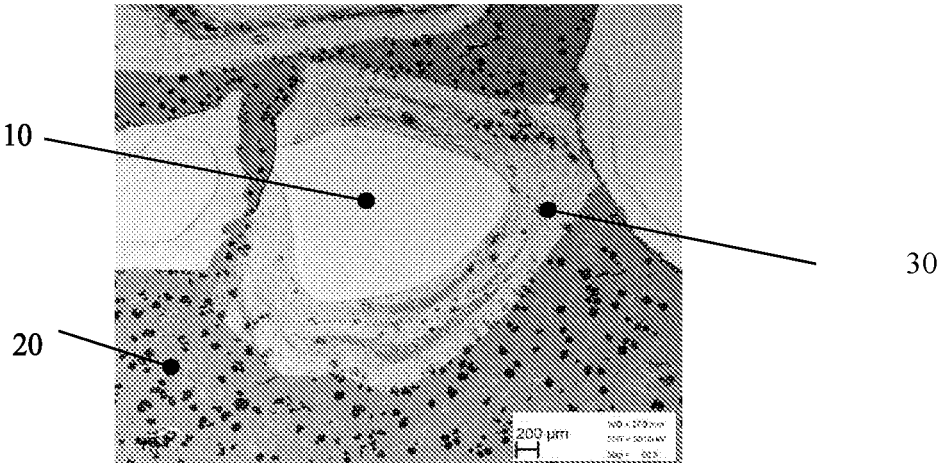

In FIGS. 2(*a*) and 2(*b*), there are illustrations of the structure of the composite material in macro scale magnification (i.e. 50 times). FIG. 2(*a*) shows a SEM-image of a cross-section of outermost surface of the MMC. In FIG. 2(*a*), there can be observed CC grains or particles 10 bonded within a matrix of nodular cast iron 20. Between the particles 10 and the modular cast iron 20 there is an alloying or diffusion zone 30 of relatively large size and extension. The cast iron shows the light ferrite phase with spherical graphite.

FIG. 2(*b*) shows a SEM-image of the cross-section of bulk of the MMC. In FIG. 2(*b*), there can be observed CC grains or particles 10 bonded within a matrix of nodular cast iron 20. Between the particles 10 and the nodular cast iron 20 there is an alloying or diffusion zone 30 of relatively large size and extension. In FIG. 2(*b*), it may be noted that a small surface portion 40 of the CC particle has got a thin PVD coating (black) onto the surface that shows a good wetting of the cast iron.

In the composite product consisting of cemented carbide and cast iron, it is possible to locate and observe the earlier mentioned alloy formation, causing completely or partly transformed cemented carbide grains or pieces, by suitable examinations of the structure, the analysis etc. In this way, it is possible to put the earlier mentioned statements regarding particle sizes etc. of the added cemented carbide in direct relation to the corresponding conditions in the bonded state. A comparison between the original cemented carbide grains or pieces and the bonded grains consisting of cemented carbide plus transition zone shows that the last-mentioned grains have a somewhat greater volume because the alloy formation may be seen as an addition of cast iron to the hard metal core. It has been found that this growth of the bonded cemented carbide grains is favourable for the practical casting operation as well as the very construction of the composite material. On one hand, there is thus needed a close packing of the cemented carbide grains in order to reach maximum wear-resistance and to avoid an exposition of too great areas of the less wear-resistant cast iron. On the other hand, the channels between the grains must not be too narrow, which should prevent the passage of melt or cool the melt too rapidly during the casting. By a suitably chosen grain size according to the invention, the desired passages for the melt and the desired close packing have been obtained, meaning a decreased distance between the wear-resistant grains or particles because of the mentioned growth during the casting.

An explanation of the great improvements which have been obtained include the greater damping capacity and lower Young's modules of cast iron in comparison with steel. By this, the dynamic strains on the holding body will be reduced and distributed, at the same time as the load concentrated on critical parts of the joint between the hard metal and the holding bodies will also be reduced and distributed.

Thus, cast iron has proved to be superior when used in bonding the cemented carbide according to the invention, regardless of its reputation as unsuitable in components exposed to shocks. An explanation of this may be that in tools or constructional elements provided with cemented carbide bodies, the very carbide bodies are exposed to the severe impact strains or the heavy wear and said bodies distribute these strains into the holding body. Because the characterizing damping properties of cast iron depending upon the volume concentration, the shape and the dimension of the graphite present, the cast iron shall contain nodular graphite or corresponding elements.

In the following examples, there will be illustrated embodiments of the invention. Results obtained in comparing practical tests will be discussed and the importance of the structure of the material will be illustrated.

EXAMPLE 1

A first example of the invention uses SGI EN-GJS-600-10, which contains a high content of silicon.

Composition and mechanical properties of SGI EN GJS-600-10 (according to the invention): C: 3.1 wt-%, Si: 4.3 wt-%, Mn: <0.5 wt-%, P: <0.05 wt-%. 100 vol % Ferrite, $Rpo._2$: 470 MPa. Rm: 600 MPa. HBW=230, A=10%, Fatigue limit of 275 MPa which is more than 20% higher that of EN-GJS-500-7.

The used reference/prior art is SGI EN-GJS-500-7. Composition and properties of EN-GJS-500-7: C: 3.8 wt-%, Si: 1.95 wt-%, Mn: 0.7-0.8 wt-%, P: <0.08 wt-%, S: <0.02 wt %, Cr: <0.1 wt-%, Cu: 0.15-0.25 wt-%. Ceqv=4.45 wt-%. 50 vol % Pearlite, 50 vol % Ferrite, Graphite nodule: Shape 90% V/VI, Size 6 (acc. EN945-2:2018). Mech. Properties: $Rp_{0,2}$: 280 N/mm$^2$, Rm: 450 N/mm$^2$, HBW=210, A=7% (Fracture elongation)

With EN-GJS-600-10 good casting results are achieved with regards to surface finish, nodularity of the graphite and the distribution of the ferritic phase.

The tensile strength is about 150 N/mm$^2$ higher for this type of SGI in comparison to EN-GJS-500-7. The hardness is about the same. The use of EN-GJS-600-10 address the demands in wear application in relation to high percussive strength and high fatigue strength in the cast in carbide surface (CIC-surface) to avoid chipping or pullouts of CC particles or cracks/pitting of surface portions of the CIC-surface.

EXAMPLE 2

This example seeks to simulate applications where a combination of impact and abrasion may cause premature failure, known as an "Impeller in drum impact abrasion test" alternatively called the "NETL test". The test was developed by NETL-Albany Research Center. The NETL test apparatus consisted of a rotating impeller in a drum in which three specimens could be mounted simultaneously. The specimens were 76×25×12 mm (rectangular shape).

Both impeller and drum rotated at 620 and 45 RPM, respectively inside the bowl. The drum was rubber-lined to reduce noise and provide friction between the ore and the drum. Testing was performed with 0.6 kg of iron ore for each run of 15 min. Total testing time was five hours. Refilling of ore (size 19 mm to 25 mm) was made after each run. For Impact-abrasion test two specimens of each MMC type was chosen, prepared with the same kind and amounts of CC-particles: 30%: dia. 3-5 mm, 30%: diameter. 6-9 mm, 40%: diameter. 10-12 mm and cast into two types of SGI.

Results from the test: According to Prior art: Type A: with SGI of EN-GJS-500-7: Rpo,2: 280 N/mm^, Rm: 450 N/mm^, HBW=210, A=7% (Fracture elongation).

According to the invention: Type B: with SGI of EN-GJS-500-14: Rpo,2=390 MPa, Rm=480 MPa, HBW=185-215, A=14% (Fracture elongation).

The impeller in drum test with iron ore for 5 hours gave a small difference in the mass loss: Type A: 4,392 g and Type B: 3,772 g.

Small cracks and pitting in the wear flat surface could be observed for Type A.

The test shows that the MMC according to the invention has a much better performance with regards to crack resistance and the ability to withstand high percussive forces.

Comments about the test result: The observed cracks in Type A could have been promoted from heat checking during the wear test due to heat generation from the iron ore in contact points. This could indicate that Type A is prone to generate thermal-mechanical cracks.

EXAMPLE 3

Figure 3:
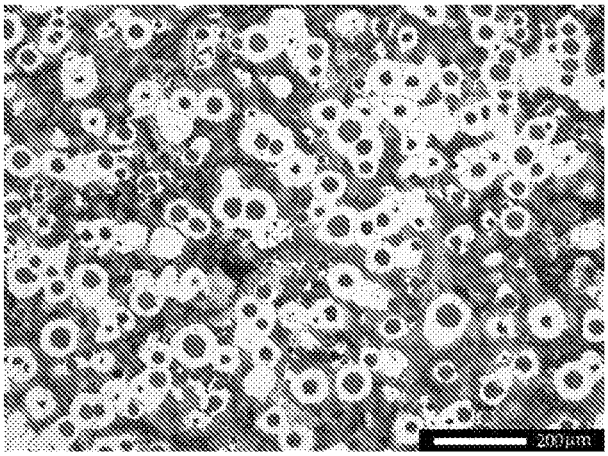
FIG. 3 shows micro structure of SGI 500-7, Nital etched.

FIG. 3 shows microstructure of SGI 500-7, Nital etched. Nital etch is also known as surface temper etch and/or temper etch. The gray phase is pearlite and the dark spherical spots is graphite surrounded by light ferrite. FIG. 3 shows the different phases in the SGI from prior art, that keeps a micro structure of pearlite and graphite nodules surrounded by a "shell" of ferrite.

Figure 4:
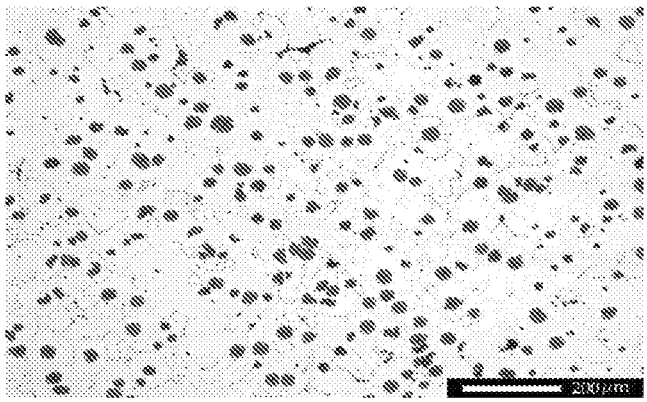
FIG. 4 shows micro structure of SGI 500-14, Nital etched.

FIG. 4 shows micro structure of SGI 500-14, Nital etched. The light phase is ferrite and the dark spherical spots is graphite. FIG. 4 shows the SGI according to the invention that shows a microstructure that keeps graphite nodules surrounded by strengthened ferrite with silicon micro-segregation.

Mechanical testing has shown the following: A comparison of 500-7 and 500-14 has not shown a significant difference in the fatigue strength even if the ductility has increased from 7% in SGI 500-7 to 14% in SGI 500-14. For an intended ultimate tensile strength of 500 MPa, the ductility is about twice as high in the solution strengthened ferritic ductile iron compared to conventional ferritic-pearlitic ductile iron, combined with a concurrent increase of the yield strength, raising the Rpo^/Rm ratio from about 0.6 to 0.8. The fracture toughness is much better than for ferritic-pearlitic irons. The impact energy behaviour is almost the same. The performance life was more than two times better in the wear plates of MMC with CC-granules tested in transporting belts of iron ore.

As indicated before, the manufacturing of actual objects ready for use can be done in such a way that they only consist of cemented carbide bonded within cast iron.

Depending upon the kind of use, it has been found that the least mean intersection size through the space of the object consisting of hard metal bonded within cast iron should be 2-100 mm. Suitably, said interval should be 3-75 mm and preferably 5-50 mm. The proportion of cemented carbide or of hard principles in the part being exposed to wear should be 30-70 percent by volume. It should suitably be 35-65 percent by volume and preferably 40-60 percent by volume. It should also be observed that there is a portion of the specific part where there is no or a low amount of cemented carbide, i.e. in the portion of the part adapted to mounting of the part in the specific machine/equipment.

Figure 5:
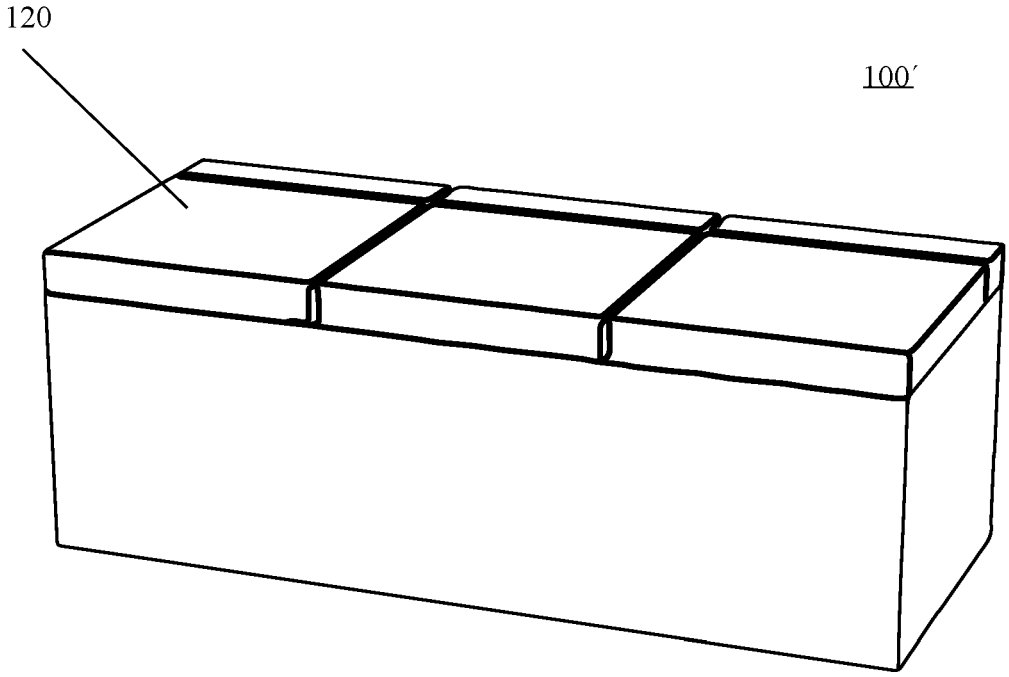
FIG. 5 shows an example of a composite according to an alternative embodiment of an aspect of the invention; and, FIG. 6 shows the main steps in a method of manufacturing a composite body in accordance with an aspect of the present invention.
Figure 6:
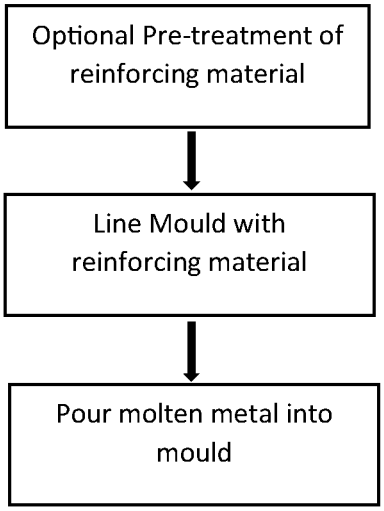

Use of the wear resistant metal matrix composite includes products and/or components such as wear parts and/or wear protection parts such as wear plates, rollers, conveyor elements. FIG. 1 shows an example of a wear part 100, in the form of a wear plate, with granules 110 casted in the surface portion of the wear part 100. FIG. 5 shows an example of a wear part 100", in the form of a wear plate, with tiles 120 casted in the surface portion of the wear part 100". In the embodiment shown in FIG. 5, there is cemented carbide plates instead of granules in a specific embodiment suitable for smaller wear plates and/or other specific circumstances.

Alternative Embodiments

It will be appreciated that, whilst particular forms of the present invention have been hereinbefore described, the invention should not be considered to be limited to the particular embodiments shown. Rather it will be readily understood by persons skilled in the art that the invention may be implemented in various alternative configurations and in different ways within the scope of the patent claims.

The used cemented carbide could be any one or combination of any commonly known varieties with varying material properties, size, shape or form, surface treatment, and previous use. The cemented carbide could be re-used cemented carbide but also produced specifically for the wear resistant metal matrix composite.

An explanation of the great improvements which have been observed may be due to the greater damping capacity and lower Young's modules of cast iron in comparison with steel. That is, the dynamic strains on the holding body may be reduced and distributed, at the same time as the load concentrated on critical parts of the joint between the hard metal and the holding bodies will also be reduced and distributed. Thus, cast iron has proved to provide superior advantages when used in bonding the cemented carbide according to the invention, despite its prior reputation as unsuitable in components exposed to shocks.

An explanation of this may be that in tools or constructional elements provided with cemented carbide bodies, the very carbide bodies are exposed to the severe impact strains or the heavy wear and said bodies distribute these strains into the holding body. [0125] Because the characterising damping properties of cast iron depend upon the volume concentration, the shape and the dimension of the graphite present, the cast iron shall contain graphite or corresponding element.

The used cast iron, such as Spheroidal Graphite Iron, SGI, could be varied within the specified claims and is not limited to the disclosed types and/or qualities of material/SGI.

The disclosed wear resistant metal matrix composite combines extreme hardness with good shock resistance performance due to the metallurgic bond between the cemented carbide granules and the casting tough metal matrix with high mechanical strength. A zone in the metal matrix composite arranged with high-density cemented carbide (CC) granules maximises the wear performance life of a wear part constructed from the disclosed wear resistant MMC.

Furthermore, the disclosed wear resistant metal matrix composite, due to the improved hardness with shock resistance performance, reduces the amount of spalling and cracks or fractures in the material at the wear face surface.

Furthermore, the invention solves a problem in relation to re-using cemented carbide material with the result of reduced material and processing costs in relation to using virgin cemented carbide explicitly produced to be used for the specific wear part.

The components and machines produced by the process of the present invention, according to aspects thereof, have various advantages over prior art components and machines.

One such advantage of products produced by this invention, is that the mechanical attachment of a wear resistant part, such as the welding or bolting of a wear plate liner to a mining or earth moving machine or other equipment, is thereby eliminated, as, in aspects of the present invention the separate production of these two formerly discrete products are now able to be integrally produced as the machine or equipment can be made to incorporate one or more wear resistant zone therein at the appropriate positions where wear may typically occur.

Another advantage of products produced by aspects of the present invention is that, once the product does ultimately wear out, the product may be melted down and the material may be recycled to produce a new product.

The wear resistant composite or composite body of aspects of the present invention therefore consists of cemented carbide and cast metal alloy, which, due to it having at least two zones, therefore has superior properties in comparison with earlier known products and/or compositions.

Whilst throughout this specification and claims the present invention has been described as a composite material, persons skilled in the art may alternatively describe the invention as a metal matrix composite (MMC).

Whilst the present invention has been generally described with reference to particular embodiments and examples, numerous variations and modifications to the invention will become apparent to persons skilled in the art. All such variations and modification should be considered to fall within the spirit and scope of the invention as hereinbefore described and as hereinafter claimed.

The invention claimed is:

1. A composite body which is substantially formed of a casted metal material, and which includes at least one integrally formed reinforced portion incorporating a reinforcing material therein, wherein the casted metal material includes any one or a combination of iron, nodular iron, iron alloy, iron matrix, and spheroidal graphite iron, wherein the reinforcing material includes any one or a combination of carbide and ceramics, and wherein the reinforcing material comprises cemented carbide granules predominantly having a diameter in the range of about 3 mm to about 12 mm, and wherein 30 wt-% of the granules are in the range of 3 mm to 5 mm, about 30 wt-% of the granules are in the range of 6 mm to 9 mm, and about 40 wt-% of the granules are in the range of 10 mm to 12.

2. The composite body as claimed in claim 1, wherein the reinforcing material is in the form of any one or combination of granules, particles, tiles, fibres, and inserts.

3. The composite body as claimed in claim 1, wherein the reinforcing material is included up to about 50% of the total thickness of the composite body.

4. The composite body as claimed in claim 1, wherein the reinforcing material is substantially evenly distributed throughout the second zone.

5. The composite body as claimed in claim 1, wherein the reinforcing material is cemented carbide.

* * * * *